United States Patent [19]

Givati

[11] Patent Number: 4,974,983

[45] Date of Patent: Dec. 4, 1990

[54] CARD HOLDER

[75] Inventor: Izhak Givati, Tel Aviv, Israel

[73] Assignee: Shakbar Investments Ltd., Tel-Aviv, Israel

[21] Appl. No.: 329,603

[22] Filed: Mar. 28, 1989

[30] Foreign Application Priority Data

Mar. 29, 1988 [IL] Israel ..... 85917
May 20, 1988 [IL] Israel ..... 86453

[51] Int. Cl.[5] ..... B42F 13/16

[52] U.S. Cl. ..... 402/80 R; 40/493; 150/147; 150/148; 206/39; 206/232; 281/15.1; 281/30; 281/31; 281/45

[58] Field of Search ..... 40/158.1, 159, 493, 40/642, 643, 644, 661, 664; 150/145, 147, 148; 206/39, 232; 281/29, 30, 31, 39, 45, 15.1; 283/2, 106, 104, 56, 57; 402/80 R, 500, 501; 156/201

[56] References Cited

U.S. PATENT DOCUMENTS 2,161,015 6/1939 Buxton ..... 281/31 X
2,226,976 12/1940 Leaming ..... 206/39 X
2,379,672 7/1945 Buxton ..... 150/148
3,565,148 2/1971 Miller ..... 150/147
4,004,690 1/1977 Giarritta ..... 150/147 X
4,575,126 3/1986 Grubbs ..... 281/31 X
4,832,372 5/1989 Young ..... 281/31

FOREIGN PATENT DOCUMENTS 68935 5/1983 European Pat. Off. ..... 281/45

*Primary Examiner*—Paul A. Bell
*Attorney, Agent, or Firm*—Barish, Benjamin J.

[57] ABSTRACT

A card holder comprises a binder including a plurality of holder sheets each formed with a plurality of transparent pockets for holding business cards, and a plurality of blank sheets interleaved between the holder sheets, such that when the binder is open to expose one of the holder sheets on one side of the open binder, a blank sheet is simultaneously exposed on the opposite side of the binder permitting entry of information thereon pertaining to the card held by the exposed holder sheet.

19 Claims, 3 Drawing Sheets

FIG.1
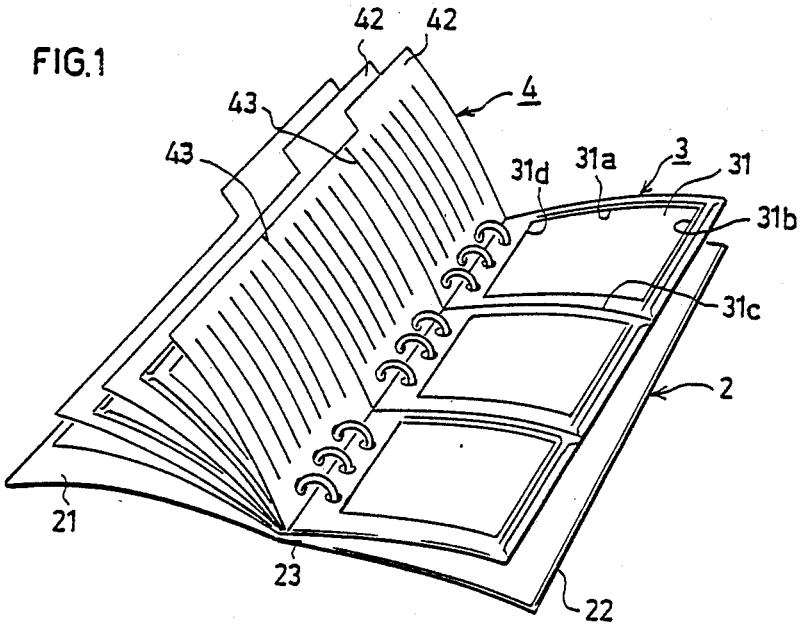
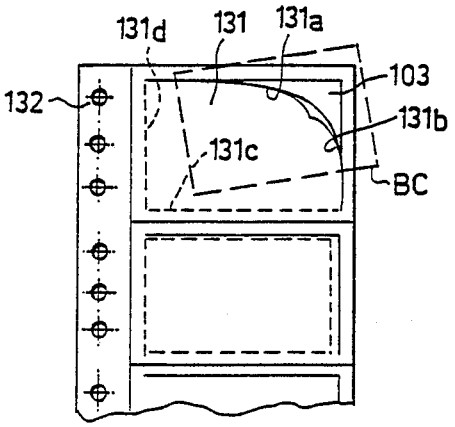
FIG. 2

CARD HOLDER

BACKGROUND OF THE INVENTION

The present invention relates to a card holder, and particularly to one for holding a plurality of business or similar cards in a manner which permits information to be conveniently entered with respect to the cards held by the holder.

Business cards are widely used in order to identify individuals and companies, including their products and services. When receiving a business card from another individual or company, particularly at trade shows, conventions and conferences where a large number of business cards are disseminated, the receiver frequently desires to note certain information about the individual business card at the time it is received. This is usually done by merely writing at that time a note on the back of the received business card, or in another note book. However, when the information is written on the back of the business card, there may be insufficient room to include all the desired information; moreover, the loose business cards frequently become lost or misplaced. When the information is written in a separate note book, the receiver must first identify the business card to which the note pertains, which is time-consuming and not always convenient; moreover, the business cards in this case may also become lost or misplaced.

A common arrangement for holding various types of cards, such as business cards, index cards, pictures, and the like, includes a transparent plastic sleeve of sufficiently large size to completely enclose the card. Such an arrangement, however, does not conveniently permit entries to be made on the card, since the card must be removed from the plastic sleeve in order to make such entries.

One object of the present invention is to provide a card holder which conveniently permits notes to be entered with respect to each card received at the time of its receipt, and which holds all the cards and the notes taken with respect to them in an organized and conveniently-accessible manner.

Another object of the present invention is to provide a card holder which not only holds the card in a manner permitting entries to be made in a quick and simple manner, but which also permits the card to be quickly removed from the holder, e.g., for filing purposes, or for disposal. Another object of the invention is to provide a card holder which can be produced in volume and at low cost.

BRIEF SUMMARY OF THE INVENTION

According to one feature of the present invention, there is provided a card holder comprising a binder including a plurality of holder sheets each formed with a plurality of transparent pockets for holding business cards; and a plurality of blank sheets interleaved between the holder sheets, such that when the binder is open to expose one of the holder sheets on one side of the open binder, a blank sheet is simultaneously exposed on the opposite side of the binder permitting entry of information thereon pertaining to the business card held by the exposed holder sheet.

In one preferred embodiment of the invention described below, each of the holder sheets is formed with at least three transparent pockets for holding at least three business cards, and each of the blank sheets is formed with a blank space for, and aligned with, each of the pockets, in the open condition of the binder.

Preferably, the card holder is of a size in which each holder sheet is formed with three transparent pockets, enabling a large number of business cards to be held in a form which is compact and which may be conveniently carried by the user.

Each of the blank sheets may be formed with severance lines to permit removal of the portion thereof pertaining to a particular business card, and also removal of the business card pertaining to the removed portion of the blank sheet, e.g., for transmission to a central office for processing, filing, or like purpose. In addition, each of the blank sheets may be formed with a projecting index tab for indexing purposes while the business card and the pertinent blank sheet remains in the holder, or after both have been removed for filing purposes.

According to a further feature of the present invention, there is provided a card holder assembly comprising: a sleeve, and a card receivable in the sleeve; the sleeve including two rectangular panels joined together along three sides and open along their fourth side for receiving the card; the panels being of a length substantially less than that of the card, and at least one of the panels being formed with an opening; the card being formed at one end with a holder tab bent out of the plane of the card and joined to the remainder of the card at its edge closest to the one end, which holder tab is receivable in the opening for holding the card within the sleeve.

Preferably, both of the panels are formed with an opening, such that the sleeve is adapted to receive two of the cards in back-to-back relation with each card being formed with one of the tabs receivable in the opening of one of the panels.

According to a still further feature of the invention, the assembly further includes a binder for binding a plurality of the sleeves together along their closed sides opposite to their open sides. The invention is particularly useful wherein the cards are blank cards for receiving information to be entered by the user, and wherein the binder includes a plurality of transparent pockets for holding business cards, interleaved between the sleeves for holding the blank cards, such that when the binder is open to expose one of the business cards on one side of the open binder, a blank card is simultaneously exposed on the opposite side of the binder permitting entry of information thereon pertaining to the exposed business card.

It will thus be seen that a card holder constructed in accordance with the foregoing features provides a convenient device for receiving and holding a plurality of cards, e.g., business cards, for taking notes as each card is received, and for holding the cards and the notes in a manner which is compact, organized and convenient for use by the person receiving the cards. It thus permits the blank card to be held so as to expose a major portion of its surface for the entry of information by the user. In addition, it permits the cards to be quickly removed from the assembly without opening a binder, e.g., a ring binder or the like. Still further, the assembly may be manufactured in volume and at low cost.

Further features and advantages of the invention will be apparent from the description below.

BRIEF DESCRIPTION OF THE DRAWINGS

The invention is herein described, by way of example only, with reference to the accompanying drawings, wherein:

FIG. 1 illustrates one form of business card holder constructed in accordance with the present invention;

FIG. 2 illustrates a modification in the construction of one of the holder sheets in the business card holder of FIG. 1;

DESCRIPTION OF PREFERRED EMBODIMENTS

FIG. 1 Embodiment

Figure 3:
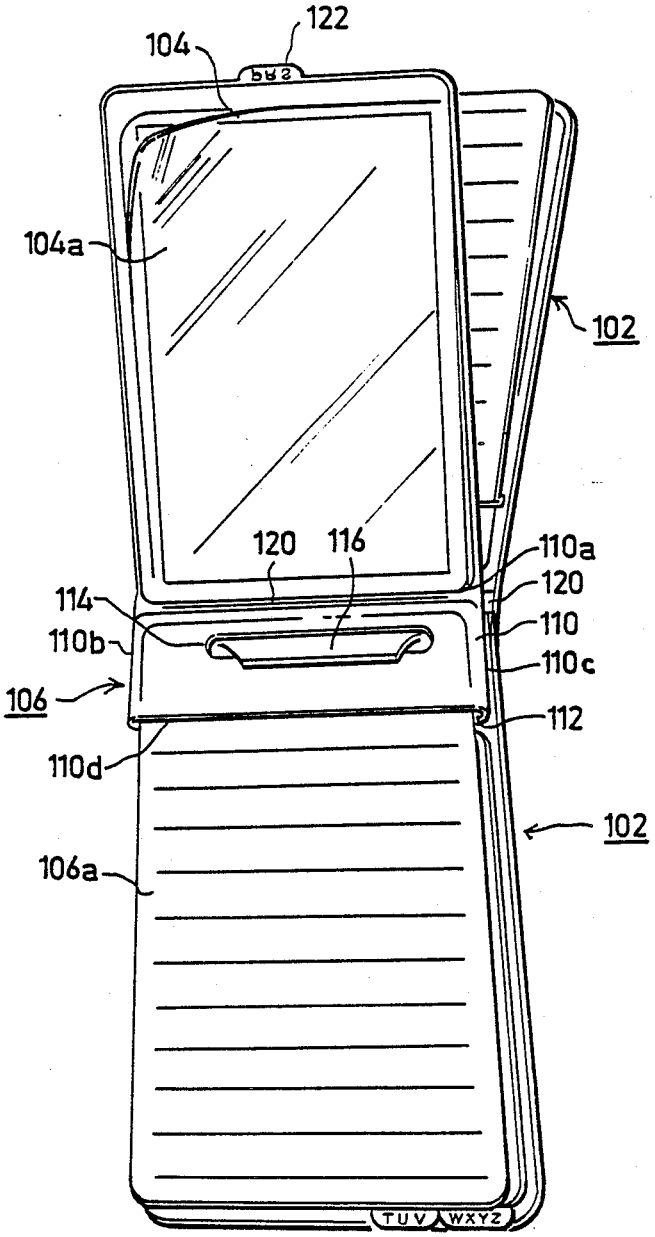
FIG. 3 is a three-dimensional view illustrating another form of card holder constructed in accordance with the present invention.

The business card holder illustrated in FIG. 1 comprises three main components, namely: a binder 2, a plurality of holder sheets 3 each formed with a plurality of transparent pockets for holding business cards; and a plurality of blank sheets for 4 interleaved between the holder sheets. The arrangement is such that when the binder is open to expose one of the holder sheets 3 on one side of the open binder (right side in FIG. 1), a blank sheet 4 is exposed on the opposite side of the binder (left side, FIG. 1), permitting entry of information in the blank sheet 4 pertaining to the business cards held by the exposed holder sheet.

More particularly, the binder 2 may be of relatively stiff material, such as plastic or cardboard, folded, or otherwise hinged, along a center spine to define a front cover 21 and a back cover 22, both of slightly larger dimensions than the holder sheets 3 and blank sheets 4 of the holder. The illustrated binder 2 is of the loose-leaf type and includes openable rings 23 to permit ready insertion and removal of the sheets held thereby.

Each of the holder sheets 3 is preferably of transparent plastic material formed with three double-sided pockets 31, each for holding two business cards in back-to-back relation, so as to enable each business card to be viewable through the two transparent faces of each pocket. In the construction illustrated in FIG. 1, the pocket 31 on each side of each holder sheet 3 is formed with three closed sides 31*a*, 31*b*, 31*c*, and one open side 31*d* facing the inner edge of the respective holder sheet, to prevent accidental removal of the business card received within the respective pocket.

Each blank sheet 4 is of the same size as the holder sheets 3 so as to be flush therewith when the binder is closed, and thereby to present a neat external appearance. Each blank sheet 4 includes blank spaces 41 permitting the user to write-in information pertaining to the business card held by the binder on the opposite side thereof in alignment with the blank sheet when the binder is in the open condition as illustrated in FIG. 1. Thus, if each holder sheet 3 includes three pockets for holding a line of three business cards on each of the sheets, each blank sheet 4 would be divided into three sections, one aligned with each of the three pockets 31.

Each blank sheet 4 preferably includes a projecting index tab 42 for indexing purposes, and may also include severance lines 43 permitting the portion of the blank sheet pertaining to a business card received in one of the pockets 31 to be severed from the remainder of the blank sheet. Thus, when a received business card is to be removed from the binder for transmission to a central office for purposes of processing, filing, or the like, the portion of the blank sheet 4 pertaining to the respective business card, and including the information entered with respect to it, may also be severed and attached to the business card.

In the arrangement illustrated in FIG. 1, wherein each pocket 31 is double-sided to receive two business cards in back-to-back relation, there would preferably be two blank sheets 4 between each pair of holder sheets 3. Thus, the information pertaining to the business cards viewable through one transparent face of the holder sheet 3 may be written on one face of the blank sheet 41, and the information pertaining to the business cards viewable through the opposite face of the holder sheet 3 may be entered on the opposite face of the other blank sheet 4, so that a portion of each of the blank sheets 4 will be separately allocated to each of the business cards held by the pockets 31 in the holder sheets 3.

FIG. 2 Embodiment

FIG. 2 illustrates a modification in the construction of the business card holder of FIG. 1, particularly in the construction of each of the holder sheets, therein designated 103. In the modification illustrated in FIG. 2, each holder sheet 103 may be of relatively stiff opaque material, e.g., cardboard or plastic, with each face formed with a plurality (e.g., three or more) of pockets 131 for receiving the business cards therein, designated BC. In this case, each pocket 131, formed on each face of the holder sheet 103 (only one face being illustrated in FIG. 2), is formed with two closed sides and two open sides, one of the open sides facing the outer edge of the holder sheet, and the other open side facing one of the other edges contiguous to the outer edge. The example illustrated in FIG. 2 includes two open edges 131*a*, 131*b* facing the outer edge and the top edge of the respective holder sheet, the remaining two sides of the pocket being closed as shown at 131*c* and 131*d*. Each of the pockets 131 is in the form of a thin pliable film so that when placed against the holder sheet 103, it adheres to the holder sheet. This arrangement enables the business cards BC to be inserted and removed from the holder sheets 103 in a very convenient manner.

As also shown in FIG. 2, each holder sheet 103, containing the pockets 131 on both sides for receiving the business cards, is formed along its inner edge with a plurality of openings 132 for insertion into the binder rings (23, FIG. 1) of the binder.

The construction of the business card holder illustrated in FIG. 2 may otherwise be the same as described above with respect to FIG. 1, and may include 1, 2 or more blank sheets 4 interleaved between each pair of holder sheets 3, to permit entry of the information pertaining to the business cards held by the holder sheets.

Figure 4:
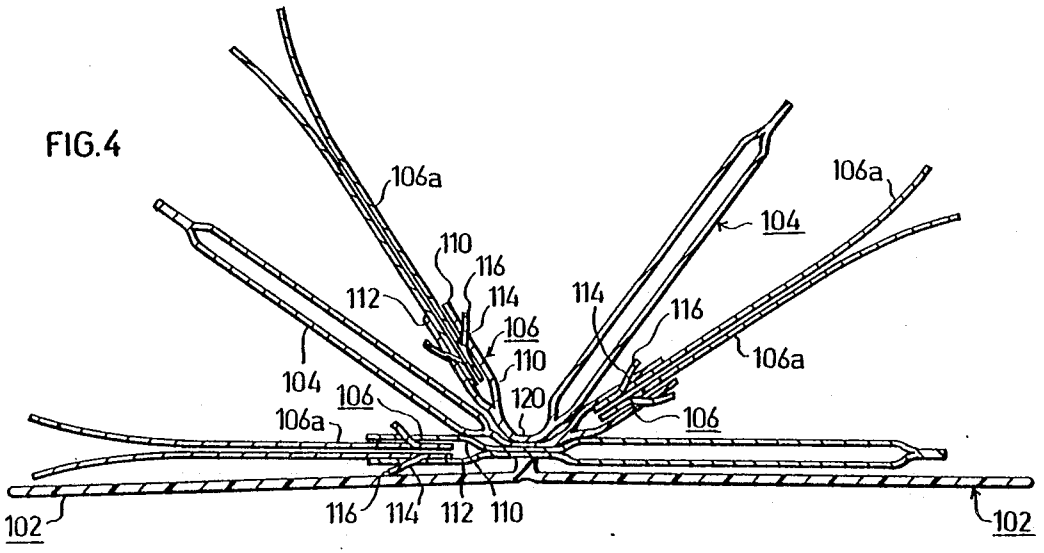
FIG. 4 is a side elevational view more clearly illustrating the construction of the card holder of FIG. 3.
Figure 5:
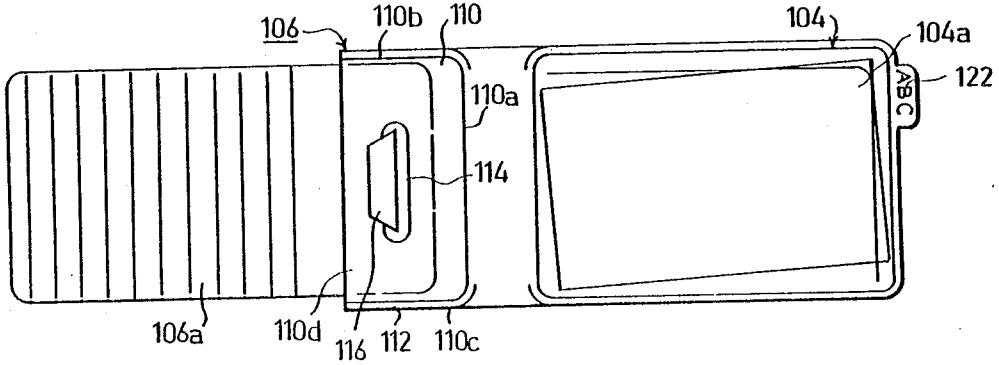
FIG. 5 is a top plan view of the card holder of FIGS. 3 and 4.

The Embodiment of FIGS. 3–5

The card holder illustrated in FIGS. 3–5 is also of the type described above for holding a plurality of business cards interleaved with a plurality of blank cards, such that when the assembly is open to expose one of the business cards on one side, a blank card is simultaneously exposed on the opposite side permitting entry of information thereon pertaining to the exposed business card.

Thus, the card holder illustrated in FIGS. 3-5 comprises a binder including front and back panels, generally designated 102, binding together a plurality of holders 104 of one type for holding business cards 104*a*, and a plurality of holders 106 of another type for holding blank sheets 106*a* which permit entries to be made with respect to an exposed business card 104*a*. Holders 104 for the business cards 104*a* are in the form of transparent plastic pockets 104 each removably receiving a business card 104*a*, so as to be completely enclosed within the respective pocket. Holders 106, however, for holding the blank cards 106*a*, are of a novel construction, as described below.

Thus, each of the holders 106 for receiving the blank cards 106*a* is constituted of two rectangular panels 110, 112 joined together along three side (e.g., sides 110*a*, 110*b*, 110*c*, FIG. 5), and open along their fourth side (110*d*, FIG. 5) for receiving the card 106*a*. The two panels 110, 112 are of a length substantially less than that of the card 106*a*; preferably, they are of a length less than one-third that of the card, in order to permit a major part of the card to be used for receiving entries. In the illustrated example, each of the panels 110, 112 is approximately one-sixth the length of its respective card 106*a*.

Also in the illustrated example, each of the plastic pockets 104 is adapted to receive two business cards 104*a* in back-to-back relationship, so as to expose the information contained on each business card through the opposite faces of the transparent pocket. Accordingly, the holders 106 for the blank cards 106*a* are also adapted to receive two blank cards 106*a* in back-to-back relationship, so that a separate blank card will be available for each of the business cards. It is contemplated, however, that holders 106 may each include a single blank card 106*a*, whereby the two opposite faces of each blank card would be available for the two business cards exposed via the transparent pockets 104.

Each of the two panels 110, 112 defining the holder 106 for the blank cards 106*a* is formed with an elongated opening 114 centrally of the panel. In addition, each of the business cards 106*a* is integrally formed at one end with a holder tab 116 bent out of the plane of the card and joined to the remainder of the card at its edge closest to the bound end 110*a* of the panels. Tab 116 of each blank card 106*a* is receivable within opening 114 formed in the respective panels 110, 112 for holding the business card within the sleeve defined by the two panels.

Transparent pocket holders 104 for the business cards 104*a*, and the two panels 110, 112 for each of the holders 106 for the blank sheets 106*a*, together with the two cover panels 102 of the binder, may all be made of plastic sheet material and bonded together at their center lines, as shown at 120, thereby providing an assembly which can be produced in volume and at low cost. The holders 104 for the business cards 104*a* may include index tabs 122.

The assembly illustrated in the drawings may be used in the following manner. Whenever a business card is received, it is inserted within the transparent pocket 104 for the appropriate index tab 122. It will be appreciated that each pocket 104 can receive two business cards 104*a* in back-to-back relation. Each of the holders 106, interleaved with the pockets 104, is also capable of receiving two blank sheets 106*a*, such that when the assembly is open to expose any business card 104*a*, the face of one blank sheet 106*a* will also be exposed to enable entries to be made pertaining to the respective business card.

When a received business card is to be removed from the binder, e.g., for transmission to a central office for purposes of processing, filing, or the like, the respective blank card 106*a* pertaining to that business card may be easily removed by merely pulling it outwardly, whereby its tab 116 will flex as it passes through the respective opening 114 in the respective panel 110, 112 of the holder.

While the invention has been described with respect to special preferred embodiments, it will be appreciated that many variations may be made. For example, only one panel (e.g., 110 or 112) of the blank card holder 106 may be formed with the opening 114 so as to receive only one blank card, rather than two. Also, instead of only one such opening 114 in each panel, the panel may be formed with two (or more) such openings, for receiving a corresponding number of tabs 116 on the blank cards 106*a*. Other variations, modifications and applications of the invention will be apparent.

What is claimed is:

1. A card holder, comprising a binder including: a plurality of holder sheets each formed with a plurality of transparent pockets for holding business cards; and a plurality of blank sheets interleaved between the holder sheets, such that when the binder is open to expose one of the holder sheets on one side of the open binder, a blank sheet is simultaneously exposed on the opposite side of the binder permitting entry of information thereon pertaining to the business card held by the exposed holder sheet.

2. The card holder according to claim 1, wherein each of said holder sheets is formed with at least three transparent pockets for holding at least three business cards, and each of said blank sheets is formed with a blank space for, and aligned with, each of said pockets in the open condition of the binder.

3. The card holder according to claim 1, wherein each of said pockets is transparent on both its faces to enable two business cards to be held therein in back-to-back relation so as to be viewable through the two transparent faces of the pocket.

4. The card holder according to claim 3, wherein there are at least two blank sheets between each pair of holder sheets to permit entering information on the face of one blank sheet pertaining to the business card viewable through one transparent face of each pocket on the holder sheet, and entering information on the opposite face of another blank sheet pertaining to the business card viewable through the other transparent face of the pocket.

5. The card holder according to claim 1, wherein each of said blank sheets is formed with severance lines to permit removal of the portion thereof pertaining to a particular business card.

6. The card holder according to claim 1, wherein each of said blank sheets is formed with a projecting index tab for indexing purposes.

7. The card holder according to claim 1, wherein said binder is a loose-leaf binder permitting insertion and removal of both the holder sheets and the blank sheets.

8. The card holder according to claim 1, wherein each of said pockets is formed with three closed sides and one open side facing the inner edge of the holder sheet.

9. The card holder according to claim 1, wherein each of said pockets is formed with two closed sides and two open sides, one of the open sides facing the outer edge of the holder sheet, and the other open side facing one of the other edges contiguous to the outer edge.

10. The card holder according to claim 1, wherein each of said pockets comprises a sleeve including two rectangular panels joined together along three sides and open along their fourth side for receiving the card; said panels being of a length substantially less than that of the card, and at least one of said panels being formed with an opening; said card being formed at one end with a holder tab bent out of the plane of the card and joined to the remainder of the card at its edge closest to said one end, which holder tab is receivable in said opening for holding the card within said sleeve.

11. The card holder according to claim 10, wherein both of said panels are formed with openings, said sleeve being adapted to receive two of said cards in back-to-back relation, with each of said cards being formed with one of said holder tabs receivable in the opening of one of the panels.

12. The card holder according to claim 10, wherein each of said two rectangular panels has a length which is less than one third that of the card to be received.

13. A card holder, comprising: a sleeve, and a card receivable in said sleeve; said sleeve including two rectangular panels joined together along three sides and open along their fourth side for receiving the card; said panels being of a length substantially less than that of the card, and at least one of said panels being formed with an opening; said card being formed at one end with a holder tab bent out of the plane of the card and joined to the remainder of the card at its edge closest to said one end, which holder tab is recivable in said opening for holding the card within said sleeve.

14. The card holder according to claim 13, wherein both of said panels are formed with openings, said sleeve being adapted to receive two of said cards in back-to-back relation, with each of said cards being formed with one of said holder tabs receivable in the opening of one of the panels.

15. The card holder according to claim 13, wherein each of said two rectangular panels has a length which is less than one third that of the card to be received.

16. The card holder according to claim 13, further including a binder for binding a plurality of said sleeves together along their closed sides opposite to their open sides.

17. The card holder according to claim 16, wherein said binder and sleeves are of plastic material and are all bound together along the closed sides of the sleeves.

18. The card holder according to claim 16, wherein said cards are blank cards for receiving information to be entered thereon by the user, and wherein said binder includes a plurality of transparent pockets for holding business cards, interleaved between said sleeves for holding the blank cards, such that when the binder is open to expose one of the business cards on one side of the open binder, a blank card is simultaneously exposed on the opposite side of the binder permitting entry of information thereon pertaining to the exposed business card.

19. The card holder according to claim 16, wherein said transparent pockets carry index tabs along their edges opposite to those received within said sleeves.

* * * * *